US009528787B1

(12) United States Patent
Ashley

(10) Patent No.: US 9,528,787 B1
(45) Date of Patent: Dec. 27, 2016

(54) ADAPTER TIP FOR CLEANING AR GAS TUBE UPPER RECEIVER

(71) Applicant: Otis Products, Inc., Lyons Falls, NY (US)

(72) Inventor: Christopher Ashley, Liverpool, NY (US)

(73) Assignee: Otis Products, Inc., Lyons Falls, NY (US)

( * ) Notice: Subject to any disclaimer, the term of this patent is extended or adjusted under 35 U.S.C. 154(b) by 0 days.

(21) Appl. No.: 14/835,239

(22) Filed: Aug. 25, 2015

(51) Int. Cl.
*F41A 29/02* (2006.01)
*F41A 29/00* (2006.01)
*F41A 3/72* (2006.01)

(52) U.S. Cl.
CPC ..... *F41A 29/00* (2013.01); *F41A 3/72* (2013.01); *F41A 29/02* (2013.01)

(58) Field of Classification Search
CPC ..... F41A 29/00; F41A 29/02; F41A 3/72
USPC ..... 89/1.4, 1.42
See application file for complete search history.

(56) References Cited

U.S. PATENT DOCUMENTS 9,127,899 B2 * 9/2015 Shipman ..... F41C 27/00
2007/0039224 A1 * 2/2007 Skinner ..... F41A 29/00 42/106
2012/0186127 A1 * 7/2012 Shipman ..... F41A 29/02 42/95

* cited by examiner

*Primary Examiner* — Stephen M Johnson
(74) *Attorney, Agent, or Firm* — Harris Beach PLLC

(57) ABSTRACT

An adapter tip for cleaning an area around a gas tube entrance into the upper receiver of an AR rifle uses an AR charging handle of the AR rifle as an insertion handle for the adapter tip. The adapter tip includes an adapter tip body having a first leg and a second leg extending at an angle from the first leg. The first leg has a notch in a first leg interior surface shaped to accept a forward angled section of an AR charging handle. A forward extension portion of the adapter tip has a first extension end and a second extension end. One or more forward posts are mechanically coupled to and extend forward from the second extension end of the forward extension portion. A method to clean an area around a gas tube entrance into an upper receiver of an AR rifle is also described.

15 Claims, 9 Drawing Sheets

ADAPTER TIP FOR CLEANING AR GAS TUBE UPPER RECEIVER

FIELD OF THE APPLICATION

The application relates to a tool for cleaning a rifle and particularly to a tool for cleaning the area around the gas tube entrance into the upper receiver.

BACKGROUND

With each use, the component parts of a firearm accumulate fouling and debris. Most fouling and debris originates from the firearm itself, such as propellant residue (i.e., carbon deposits), priming compound, and ammunition casings (i.e., copper fragments). But fouling and debris may also originate from the environment if the firearm is used outdoors, such as: dirt, sand, mud, moisture, and plant matter. The presence of such materials can moderately to severely compromise the efficacy of a firearm absent proper periodic cleaning. Undesirable materials that remain within a firearm for a prolonged period of time can cause corrosion or other significant degradation of the firearm's components, thus potentially necessitating expensive repair or replacement of the firearm. Failure to remove the residue and debris may even pose a safety hazard to the operator. Therefore, proper cleaning is one of the most important elements of firearm ownership.

SUMMARY

According to one aspect, an adapter tip for cleaning an area around a gas tube entrance into the upper receiver of an AR rifle uses an AR charging handle of the AR rifle as an insertion handle for the adapter tip. The adapter tip includes an adapter tip body having a first leg and a second leg extending at an angle from the first leg. The first leg has a notch in a first leg interior surface shaped to accept a forward angled section of an AR charging handle. A forward extension portion of the adapter tip has a first extension end and a second extension end. The first extension end is mechanically coupled to and extends from an exterior surface of the second leg in a direction substantially parallel to the first leg. One or more forward posts are mechanically coupled to and extend forward from the second extension end of the forward extension portion.

In one embodiment, when the adapter tip is affixed to the AR charging handle and the AR charging handle is inserted into an AR upper receiver via tracks of the AR upper receiver, the one or more forward posts are caused to protrude into at least one or more gas transfer openings of the AR upper receiver to clean the gas transfer openings.

In another embodiment, the first leg extends at about a right angle to the second leg.

In yet another embodiment, the forward extension portion includes a mounting post which mounts in an opening of the second extension end.

In yet another embodiment, the forward extension portion is welded or glued to the exterior surface of the second leg of the second extension end.

In yet another embodiment, the forward extension portion is bolted to the exterior surface of the second leg of the second extension end.

In yet another embodiment, the first extension end of the forward extension portion includes threaded portion which is threadingly coupled to a corresponding threaded hole in the second leg.

In yet another embodiment, the first leg, the second leg and the forward extension portion are part of a monolithic structure.

In yet another embodiment, the monolithic structure includes a molded structure.

In yet another embodiment, the adapter tip includes a metal.

In yet another embodiment, the adapter tip includes a non-metallic material.

In yet another embodiment, the adapter tip includes a Nylon 66 material.

In yet another embodiment, the adapter tip includes a material selected from the group consisting of ABS, Nylon, Delrin, Nylon 6, Polyethylene, and Polycarbonate.

According to another aspect, an adapter tip for cleaning an area around a gas tube entrance into the upper receiver of an AR rifle uses an AR charging handle of the AR rifle as an insertion handle for the adapter tip. The adapter tip includes an adapter tip body having a first leg and a second leg extending at an angle from the first leg. The first leg has a notch in a first leg interior surface shaped to accept a forward angled section of an AR charging handle. A forward extension portion of the adapter tip has a first extension end and a second extension end. The first extension end is mechanically coupled to and extends from an exterior surface of the second leg in a direction substantially parallel to the first leg. One or more forward posts are mechanically coupled to and extend forward from the second extension end of the forward extension portion. When the adapter tip is affixed to the AR charging handle and the AR charging handle is inserted into an AR upper receiver via tracks of the AR upper receiver, the one or more forward posts protrude into at least one or more gas transfer openings of the AR upper receiver to clean the gas transfer openings.

According to yet another aspect, a method to clean an area around a gas tube entrance into the upper receiver of an AR rifle includes the steps of: providing an adapter tip having a notch to accept an angled front of an AR charging handle; mounting the adapter tip to the angled front of an AR charging handle; inserting the AR charging handle into a pair of tracks of an AR upper receiver; advancing the adapter tip into the AR upper receiver by advancing the AR charging handle into the AR upper receiver; and continuing to advance the AR charging handle into the AR upper receiver to where at least one or more forward posts of the adapter tip protrude into at least one or more gas transfer openings of the AR upper receiver to clean the gas transfer openings.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

The AR-15 was first built in 1959 by ArmaLite as a small arms rifle. Both the original design as well as many variants are now generally referred to as an "AR" type rifle. Modern weapons such as the AR type rifles are cleaned periodically to maintain the operating condition of the weapon. Cleaning tools should be efficient and easy to use. Moreover, cleaning tools should add as little burden as possible to what a soldier needs to carry into the field. There is a need for gun cleaning tools which maintain superior cleaning capabilities without adding significant weight to that which a soldier needs to pack into the combat theater.

It was realized that some parts of a rifle themselves can be adapted for double duty, both for their intended purpose and as a part of a cleaning tool apparatus used for regular weapons maintenance. For example, this application describes a new type of adapter tip which when installed onto an end of the regular AR charging handle, such as the AR charging handle of the same weapon, can be used as an AR gas tube upper receiver cleaning apparatus. The new tool is particularly well suited to clean the area around the gas tube entrance into the upper receiver.

Figure 1:
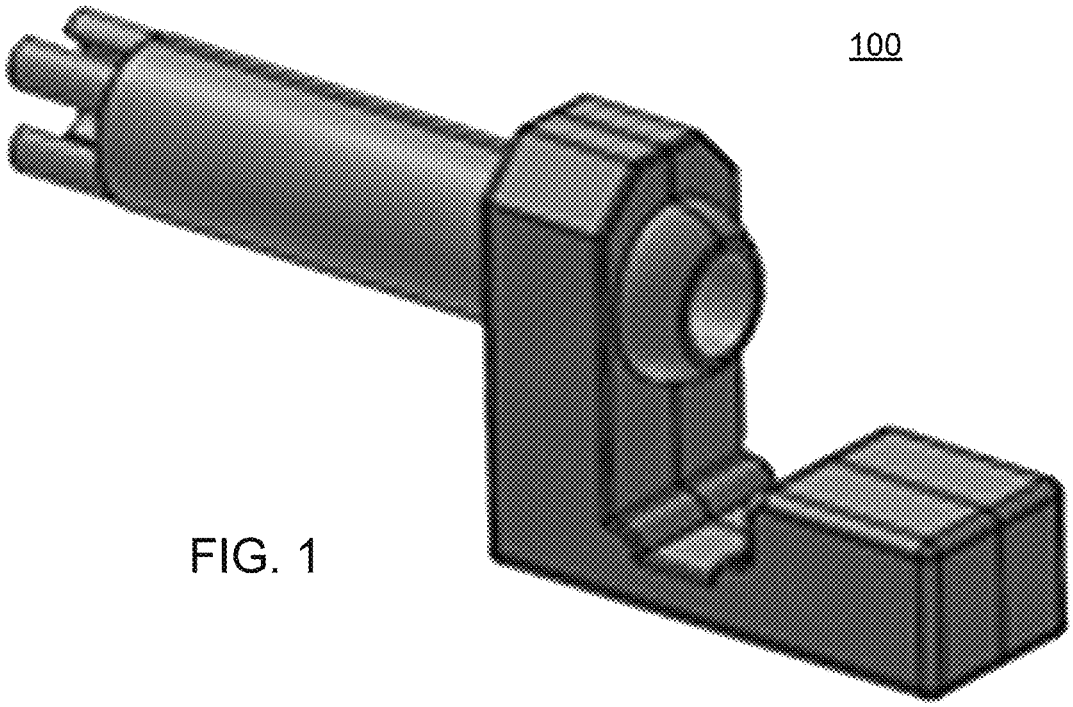
FIG. 1 shows an isometric view of an exemplary AR gas tube upper receiver cleaner adapter tip.
Figure 2:
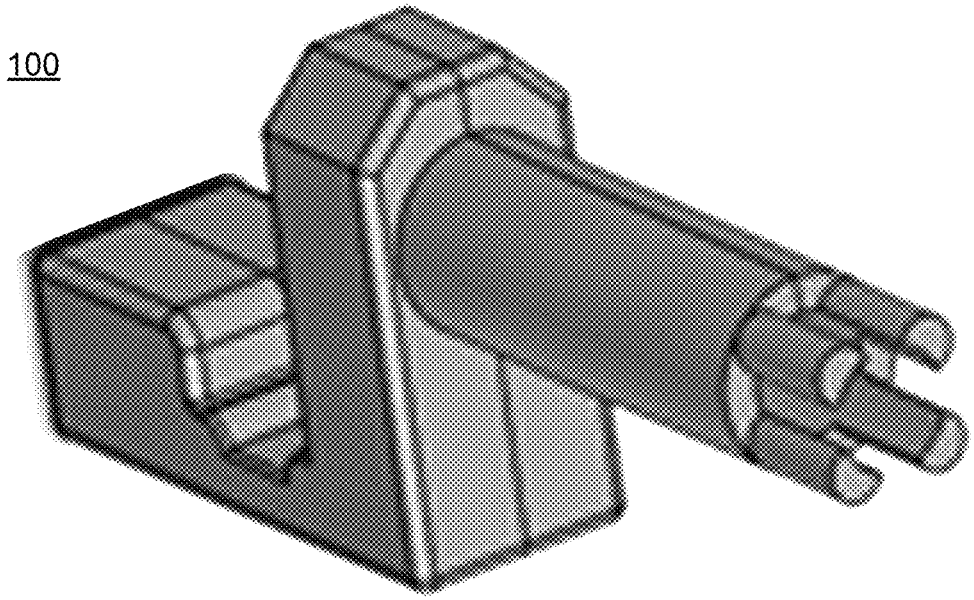
FIG. 2 shows another isometric view of the adapter tip of FIG. 1.

In one exemplary embodiment, as illustrated by FIG. 1 and FIG. 2, an adapter tip 100 for cleaning an AR gas tube upper receiver (e.g. FIG. 9, 901) of an AR rifle uses an AR charging handle (e.g. FIG. 7, 701) of an AR rifle as an insertion handle for the adapter tip. The adapter tip includes an adapter tip body FIG. 3, 300 having a first leg 301 and a second leg 302 extending at an angle from the first leg. The first leg 301 includes a notch 303 in a first leg interior surface 305. The notch 303 is shaped to accept a forward angled section FIG. 8, 801 of an AR charging handle 701. A forward extension portion 310 of the adapter tip has a first extension end 311 and a second extension end 313. The first extension end 311 is mechanically coupled to and extends from an exterior surface 312 of the second leg 302 in a direction substantially parallel to the first leg 301. The forward extension portion includes at least one or more forward posts 330 which extend from the second extension end 313.

Figure 3:
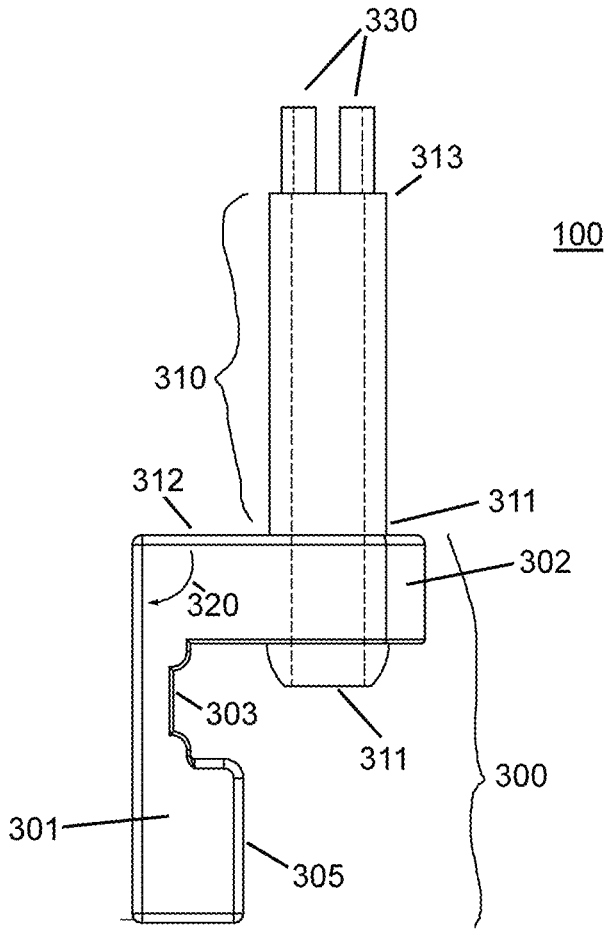
FIG. 3 shows a side view of the adapter tip of FIG. 1.

In some embodiments, the forward extension portion can begin at the outer surface 312 of leg 302, extend part way into leg 302 (e.g. by a threaded portion of the forward extension portion threading into a corresponding threaded hole of leg 302), or can be inserted and extend through leg 302 as shown in the exemplary embodiment of FIG. 3.

Figure 9:
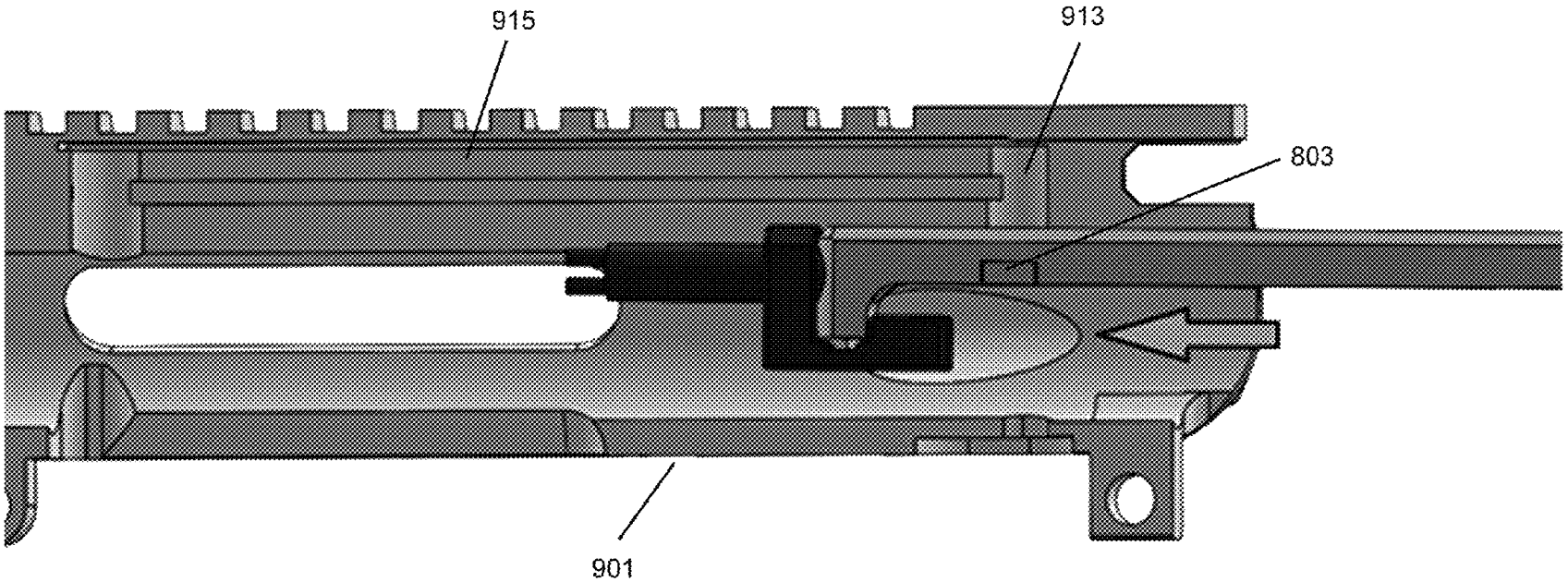
FIG. 9 shows a drawing illustrating the adapter tip of FIG. 1 positioned for insertion into a cutaway view of an upper receiver.
Figure 12:
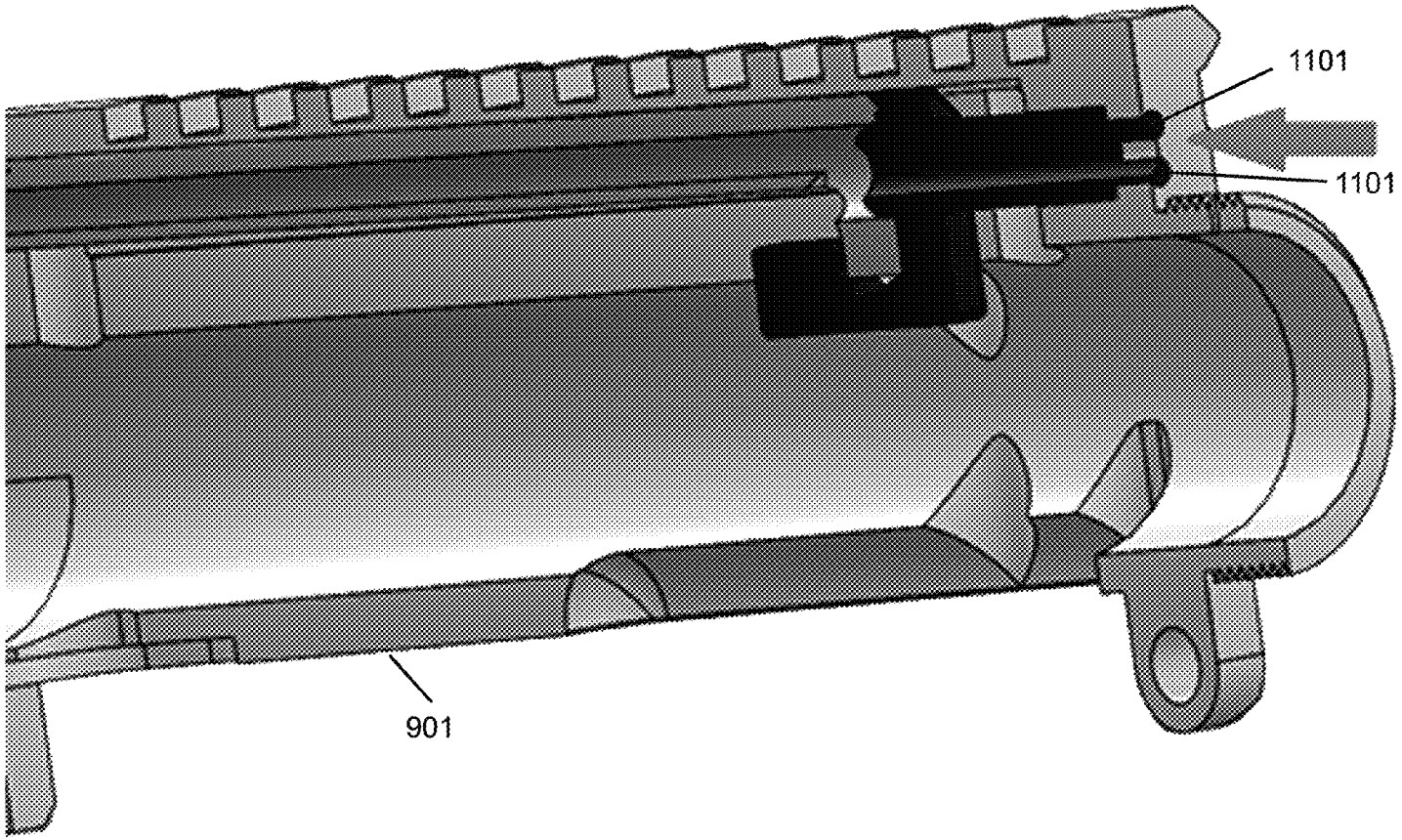
FIG. 12 shows a drawing illustrating the adapter tip upper receiver cleaner advanced fully forward into the upper receiver.

When the adapter tip is affixed to the AR charging handle and the AR charging handle is fully inserted into the AR upper receiver via tracks of the AR upper receiver FIG. 9, 901, the at least one or more forward posts 330 protrude into at least one or more gas transfer openings FIG. 12, 1201 of the upper receiver to clean the gas transfer openings 1201.

The first leg is typically disposed at about a right angle (FIG. 3, 320) to the second leg. Other angles are possible, however, the long axis of the forward extension portion 301 typically remains substantially parallel to a long or longitudinal axis of the first leg 301.

In some embodiments, the forward extension portion of the adapter tip mounts into an opening (e.g. FIG. 4, 401) of the second extension end. In other embodiments, the forward extension is welded or glued to the exterior surface of the second leg of the second extension end. Or, the forward extension could be bolted to the exterior surface of the second leg of the second extension end. Alternatively, the first portion of the forward extension can be threaded and threadingly coupled into a corresponding threaded hole in the second leg 302.

The first leg, second leg, and forward extension could also be part of a monolithic structure. The monolithic structure could be, for example a molded structure. A molded monolithic structure can be made from a metal or a non-metallic material.

FIG. 1 shows an isometric view of an exemplary AR Gas tube upper receiver cleaner adapter tip 100. FIG. 2 shows another isometric view of the adapter tip 100 of FIG. 1.

Figure 7:
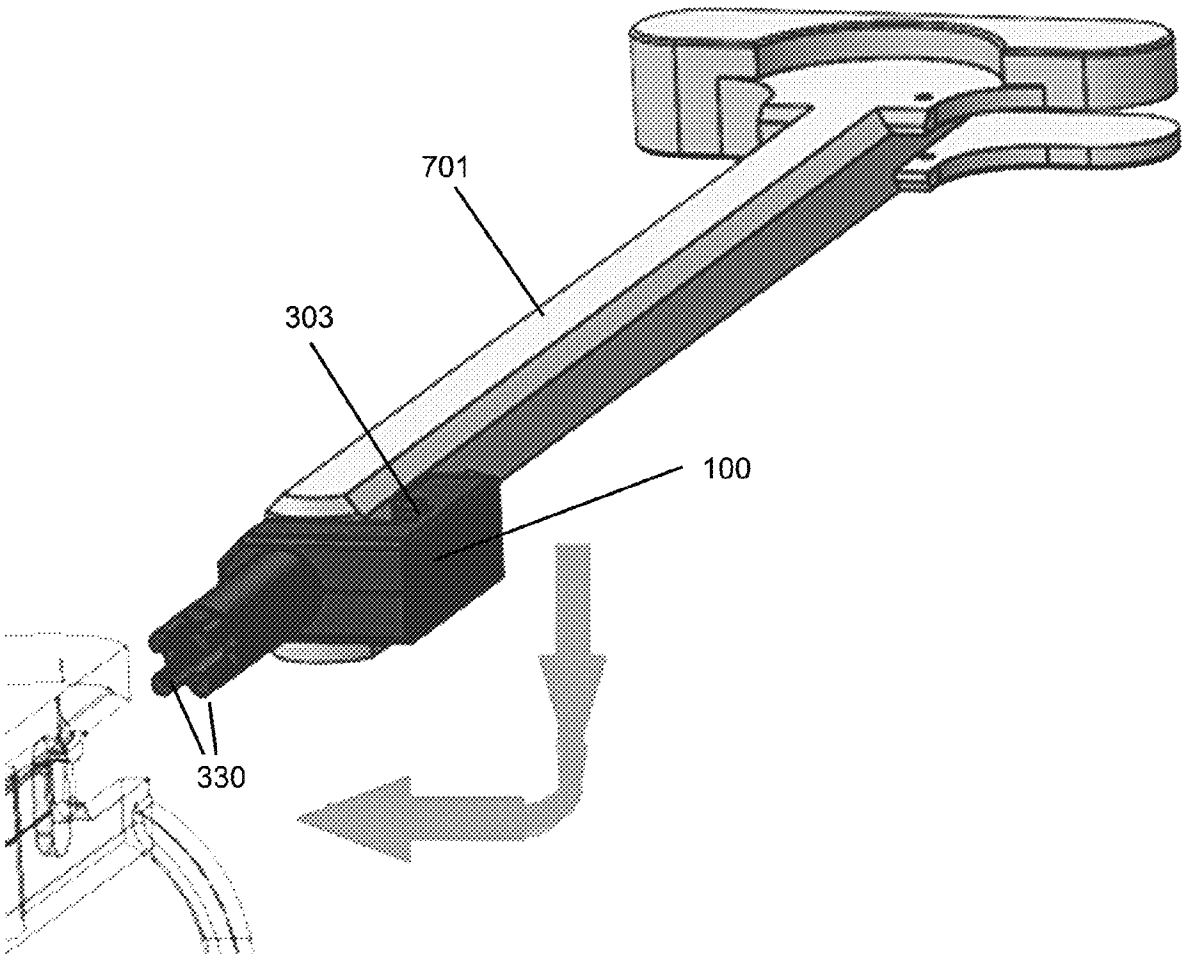
FIG. 7 shows a drawing illustrating the adapter tip of FIG. 1 affixed to an exemplary AR charging handle.

FIG. 3 shows a side view of the adapter tip of FIG. 1. In the exemplary embodiment of FIG. 3, first leg 301 and second leg 302 are substantially perpendicular to each other as shown by about 90° angle 320. In this exemplary embodiment, forward extension portion 310 can be seen to extend through opening (FIG. 4, 401) of second leg 302. Regardless of how forward extension portion 310 is mechanically coupled to second leg 302, forward extension portion 310 extends forward from the exterior surface 312 of second leg 302. Notch 303 formed in the interior surface 305 of first leg 301 is shaped to accept a forward angled section (FIG. 8, 801) of an AR charging handle (FIG. 7, 701). A first extension end 311 in the embodiment of FIG. 3, extends into and through the first leg 301. Forward posts 330 extend from the second extension end 313 of the forward extension portion 310.

Figure 4:
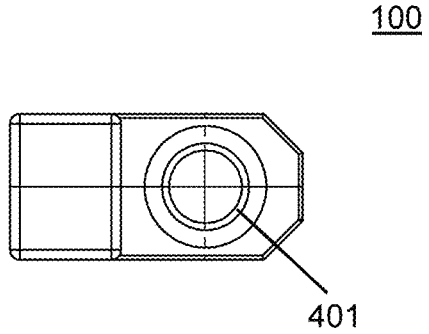
FIG. 4 shows a rear view of the adapter tip of FIG. 1.
Figure 5:
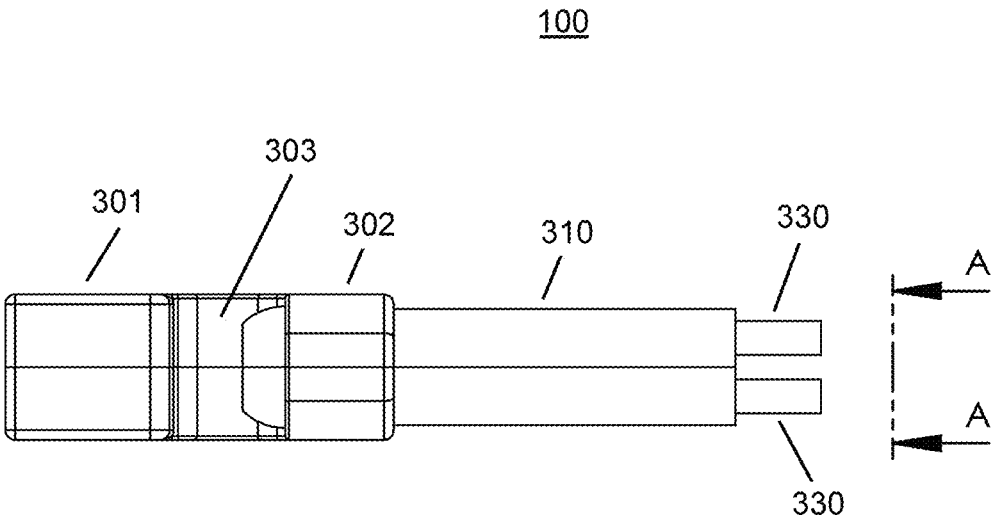
FIG. 5 shows a top view of the adapter tip of FIG. 1.
Figure 6:
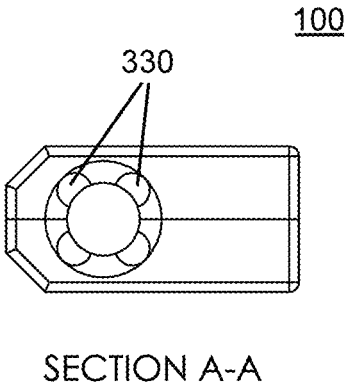
FIG. 6 shows a front view of the adapter tip of FIG. 1.

FIG. 4 shows a rear view of the adapter tip of FIG. 1. In some embodiments, the forward extension portion 310 of the adapter tip extends into and/or through second leg 302. FIG. 5 shows a top view of the adapter tip of FIG. 1. FIG. 6 shows a front view of the adapter tip of FIG. 1, and another view of the forward posts 330 which extend forward from the forward extension portion 310.

FIG. 7 shows a drawing illustrating the adapter tip of FIG. 1 affixed to an exemplary AR charging handle. The front of the charging handle is shown inserted into the notch 303 (e.g. a dome radius) of the adapter tip 100. The adapter tip 100 is rotated 90° along its long axis from the position show in FIG. 7 to lock the charging handle into the adapter tip 100.

Figure 8:
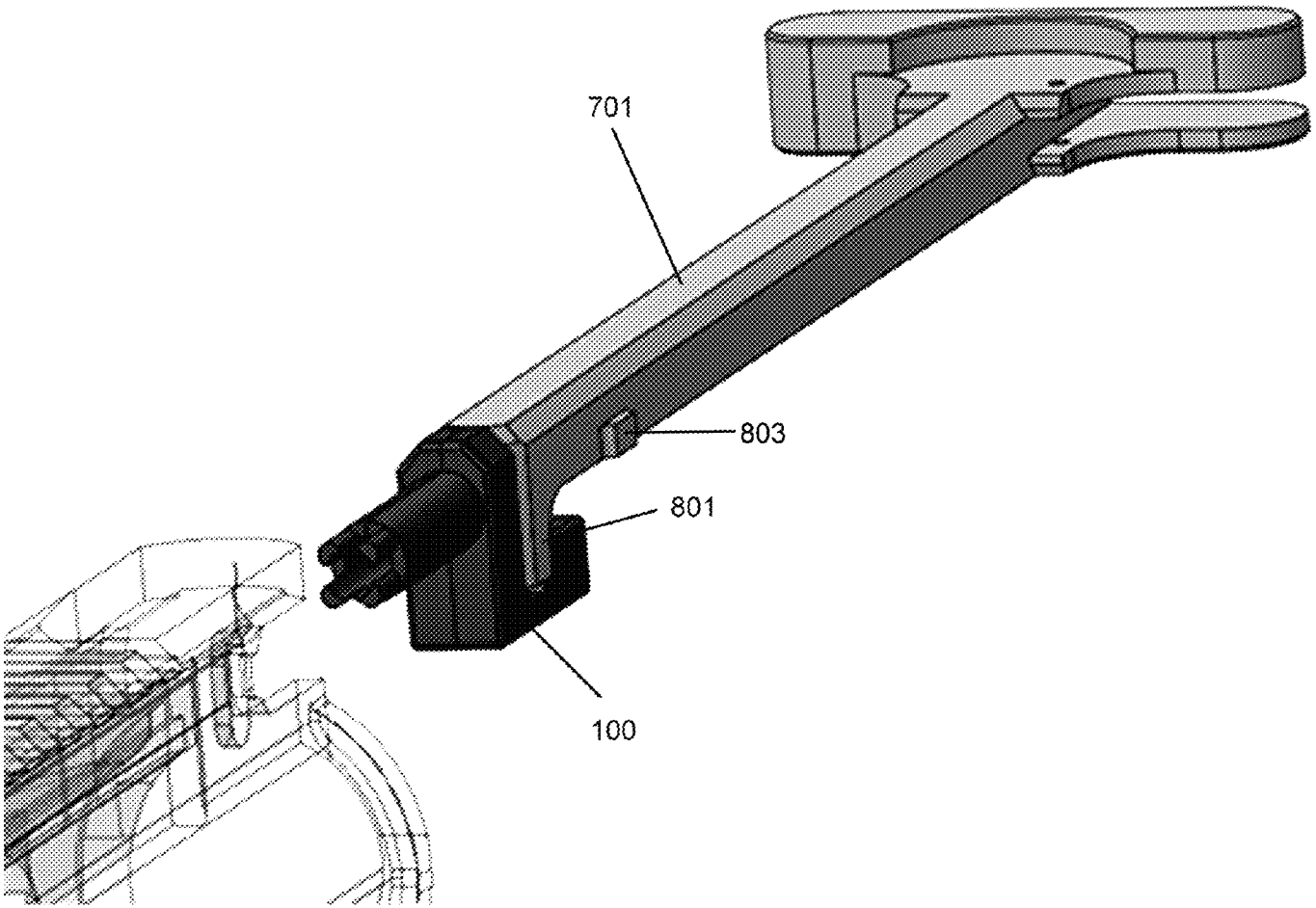
FIG. 8 shows a drawing illustrating the adapter tip of FIG. 1 positioned for insertion into an upper receiver.

FIG. 8 shows a drawing illustrating the adapter tip of FIG. 1 positioned for insertion into an upper receiver. The adapter tip 100 is shown in the engaged position with charging handle 701 to create the combined charging handle-adapter tool upper receiver cleaning apparatus. Tab 803 is shown on one side of the charging handle. A similar tab 803 on the other side of the charging handle is not visible in FIG. 8. Tabs 803 ride in slots of the upper receiver.

FIG. 9 shows a drawing illustrating the adapter tip of FIG. 1 positioned for insertion into a cutaway view of an upper receiver. After the tool is attached to the charging handle, the charging handle-adapter tip assembly is inserted via its normal path in the upper receiver 901. Tab 803 is shown positioned under notch opening 913 so that the charging handle-adapter tip assembly can be raised to insert tabs 803 into slots 915 (only one slot 915 is visible in the cut-away drawing of FIG. 9).

Figure 10:
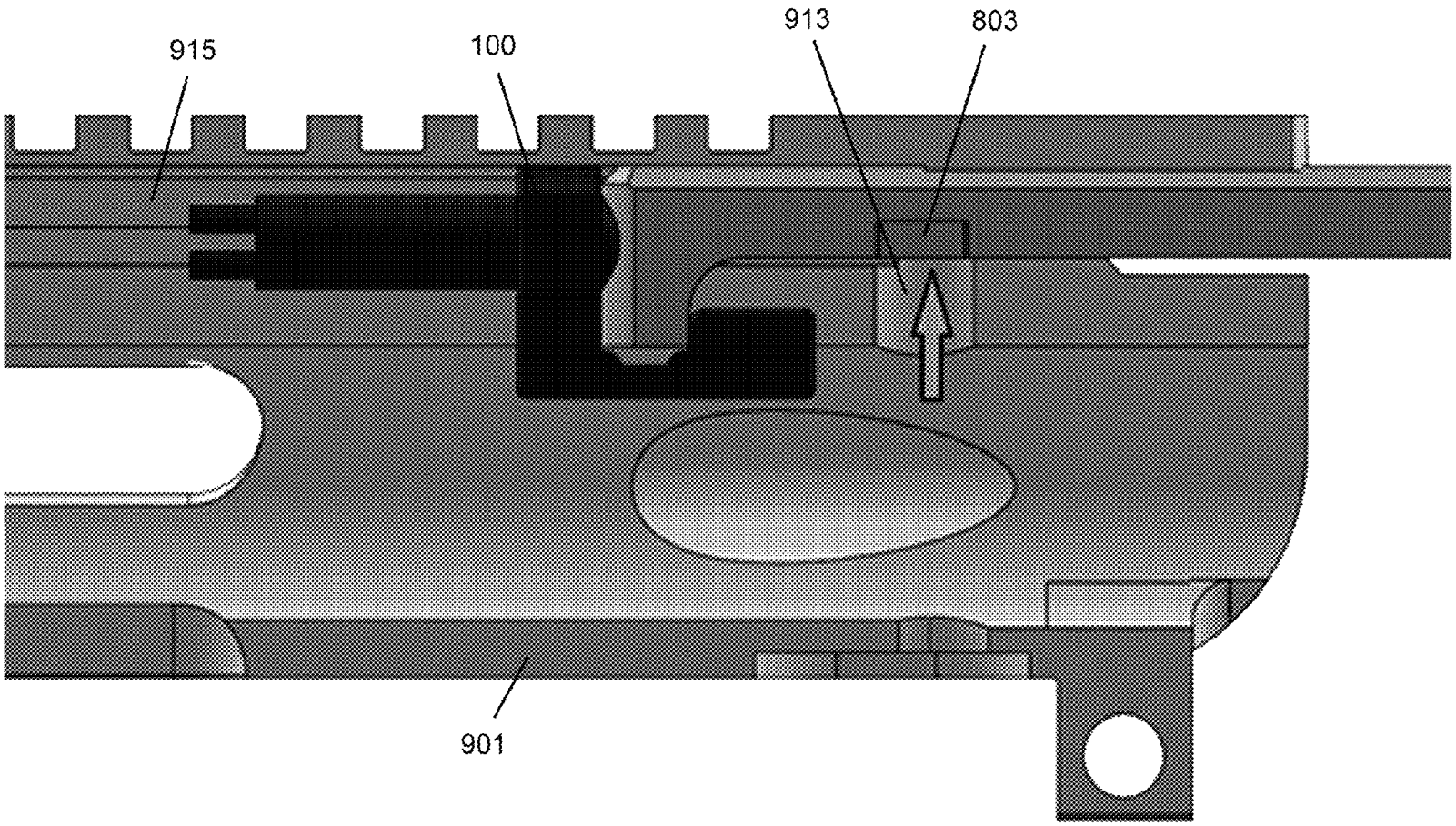
FIG. 10 shows a drawing illustrating the charging handle inserted into the notch of the upper receiver in the normal manner.

FIG. 10 shows a drawing illustrating the charging handle inserted into the notch of the upper receiver 901 in the normal manner. The charging handle-adapter tip assembly has been raised up with tab 803 traveling through the notch opening 913, so that tab 803 can be slid forward into slot 915.

Figure 11:
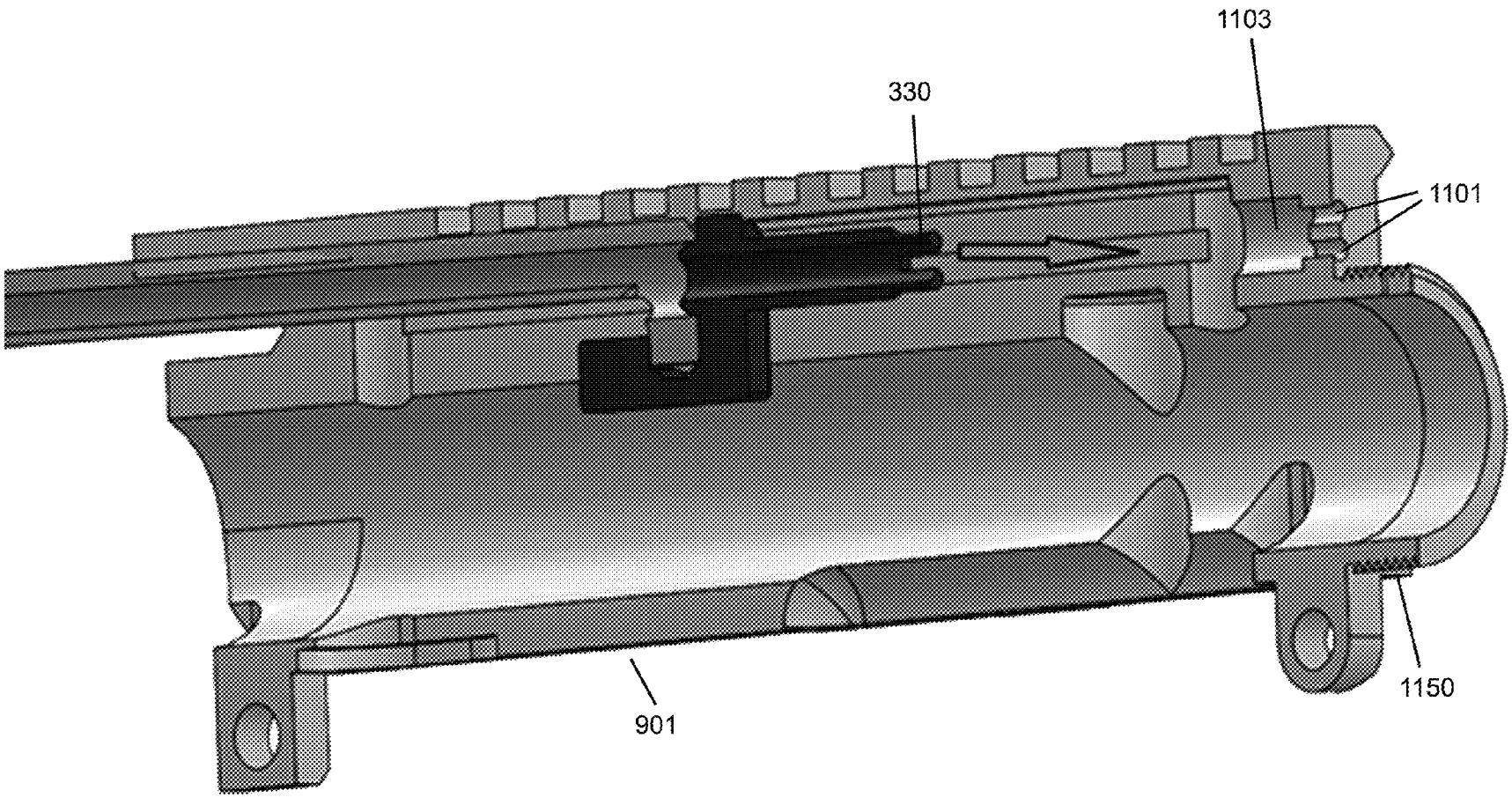
FIG. 11 shows a drawing illustrating how the forward posts of the adapter tip are aligned to engage the gas transfer openings of the upper receiver.

FIG. 11 shows a drawing illustrating how the forward posts of the adapter tip are aligned to engage the gas transfer openings of the upper receiver. In FIG. 11, the cutaway view of the upper receiver 901 and charging handle-adapter tip assembly has been reversed right to left to show the end of the upper receiver 901 to better show the gas transfer openings 1101. Upper receiver 901 threads 1150 are shown to help those skilled in the art to better see the orientation of upper receiver 901. As the tabs 803 of the charging handle 701 ride forward in slots 915 of upper receiver 901, forward posts 330 can be seen moving towards their cleaning engagement with gas transfer openings 1101. Also, the forward extension portion 310 of the adapter tip can be seen moving into cleaning engagement with the opening 1103 of upper receiver 901. The area to be cleaned includes opening 1103 which is immediately behind gas transfer openings 1101, and gas transfer openings 1101.

FIG. 12 shows a drawing illustrating the adapter tip upper receiver cleaner advanced fully forward into the upper receiver. The AR gas tube cleaning tool (the charging handle-adapter tip assembly) can be seen fully seated in the areas of the upper receiver 901 to be cleaned (opening 1103 and/or gas transfer openings 1101).

An adapter tip as described hereinabove, was made from a Nylon 66 material. Other suitable materials include, ABS, Nylon, Delrin (PolyOxyMethylene (POM), homopolymer acetal (POM-H)), Nylon 6, Polyethylene, and, Polycarbonate. An adapter tip could also be made from any suitable metal, such as, for example, steel or aluminum. Typically the adapter tip can be made in one piece, such as, for example, by injection molding. Other suitable manufacturing processes include machining, and metal injection molding (MIM).

An adapter tip as described hereinabove can be shaped and dimensioned to clean the area around the gas tube entrance into the upper receiver of many upper receiver types. One skilled in the art will understand that there might be other embodiments having slight variations for cleaning other similar, but somewhat variant upper receiver types.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An adapter tip for cleaning an area around a gas tube entrance into an upper receiver of an AR rifle uses an AR charging handle of the AR rifle as an insertion handle for the adapter tip, the adapter tip comprising:

an adapter tip body having a first leg and a second leg extending at an angle from said first leg, said first leg having a notch in a first leg interior surface shaped to accept a forward angled section of an AR charging handle;

a forward extension portion of said adapter tip having a first extension end and a second extension end, said first extension end mechanically coupled to and extending from an exterior surface of said second leg in a direction substantially parallel to said first leg; and one or more forward posts mechanically coupled to and extending forward from said second extension end of said forward extension portion.

2. The adapter tip of claim 1, wherein when said adapter tip is affixed to the AR charging handle and the AR charging handle is inserted into an AR upper receiver via tracks of the AR upper receiver, said one or more forward posts are caused to protrude into at least one or more gas transfer openings of said AR upper receiver to clean said gas transfer openings.

3. The adapter tip of claim 1, wherein said first leg extends at about a right angle to said second leg.

4. The adapter tip of claim 1, wherein said forward extension portion comprises a mounting post which mounts in an opening of said second extension end.

5. The adapter tip of claim 1, wherein said forward extension portion is welded or glued to said exterior surface of said second leg of said second extension end.

6. The adapter tip of claim 1, wherein said forward extension portion is bolted to said exterior surface of said second leg of said second extension end.

7. The adapter tip of claim 1, wherein said first extension end of said forward extension portion comprises threaded portion which is threadingly coupled to a corresponding threaded hole in said second leg.

8. The adapter tip of claim 1, wherein said first leg, said second leg and said forward extension portion are part of a monolithic structure.

9. The adapter tip of claim 8, wherein said monolithic structure comprises a molded structure.

10. The adapter tip of claim 1, wherein said adapter tip comprises a metal.

11. The adapter tip of claim 1, wherein said adapter tip comprises a non-metallic material.

12. The adapter tip of claim 11, wherein said adapter tip comprises a Nylon material.

13. The adapter tip of claim 11, wherein said adapter tip comprises a material selected from the group consisting of acrylonitrile butadiene styrene (ABS), Nylon, PolyOxyMethylene (POM), homopolymer acetal (POM-H), Polyethylene, and Polycarbonate.

14. An adapter tip for cleaning an area around a gas tube entrance into an upper receiver of an AR rifle uses an AR charging handle of the AR rifle as an insertion handle for the adapter tip, the adapter tip comprising:

an adapter tip body having a first leg and a second leg extending at an angle from said first leg, said first leg having a notch in a first leg interior surface shaped to accept a forward angled section of an AR charging handle;

a forward extension portion of said adapter tip having a first extension end and a second extension end, said first extension end mechanically coupled to and extending from an exterior surface of said second leg in a direction substantially parallel to said first leg;

one or more forward posts mechanically coupled to and extending forward from said second extension end of said forward extension portion; and wherein when said adapter tip is affixed to the AR charging handle and the AR charging handle is inserted into an AR upper receiver via tracks of the AR upper receiver, said one or more forward posts protrude into at least one or more gas transfer openings of the AR upper receiver to clean said gas transfer openings.

15. A method to clean an area around a gas tube entrance into an upper receiver of an AR rifle comprising the steps of:

providing an adapter tip having a notch to accept an angled front of an AR charging handle;

mounting said adapter tip to the angled front of an AR charging handle;

inserting the AR charging handle into a pair of tracks of an AR upper receiver;

advancing the adapter tip into the AR upper receiver by advancing the AR charging handle into the AR upper receiver; and continuing to advance the AR charging handle into said AR upper receiver to where at least one or more forward posts of said adapter tip protrude into at least one or more gas transfer openings of the AR upper receiver to clean said gas transfer openings.

* * * * *